US007461756B2

(12) United States Patent
Pedmo et al.

(10) Patent No.: US 7,461,756 B2
(45) Date of Patent: Dec. 9, 2008

(54) PLASTIC CONTAINER HAVING A FREESTANDING, SELF-SUPPORTING BASE

(75) Inventors: Marc A. Pedmo, Brunswick, OH (US); Richard C. Darr, Medina, OH (US); Christopher E. Kaminski, North Royalton, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 182 days.

(21) Appl. No.: 11/246,868

(22) Filed: Oct. 7, 2005

(65) Prior Publication Data

US 2007/0045220 A1 Mar. 1, 2007

Related U.S. Application Data

(63) Continuation-in-part of application No. 29/235,870, filed on Aug. 8, 2005, now Pat. No. Des. 543,462.

(51) Int. Cl.
*B65D 1/02* (2006.01)
*B65D 1/42* (2006.01)
*B65D 23/00* (2006.01)

(52) U.S. Cl. ..... 215/375; 220/608; 220/609

(58) Field of Classification Search ..... 215/375, 215/373; 220/608, 609
See application file for complete search history.

(56) References Cited

U.S. PATENT DOCUMENTS 3,598,270 A * 8/1971 Adomaitis et al. ..... 215/375
3,727,783 A * 4/1973 Carmichael ..... 215/375
3,935,955 A * 2/1976 Das ..... 215/375
4,249,667 A * 2/1981 Pocock et al. ..... 215/375
4,850,494 A * 7/1989 Howard, Jr. ..... 215/375
4,867,323 A * 9/1989 Powers ..... 215/375
4,978,015 A * 12/1990 Walker ..... 215/375
5,064,080 A 11/1991 Young et al.
5,139,162 A * 8/1992 Young et al. ..... 215/375
5,287,978 A 2/1994 Young et al.
5,320,230 A * 6/1994 Hsiung ..... 215/375
5,427,258 A * 6/1995 Krishnakumar et al. ..... 215/400
5,454,481 A * 10/1995 Hsu ..... 220/608
5,529,196 A * 6/1996 Lane ..... 215/375
5,549,210 A * 8/1996 Cheng ..... 215/375
5,615,790 A 4/1997 Young et al.
5,906,286 A * 5/1999 Matsuno et al. ..... 215/375
6,019,236 A * 2/2000 Slat ..... 215/375
6,085,924 A * 7/2000 Henderson ..... 215/375
6,276,546 B1 * 8/2001 Davis et al. ..... 215/375
6,908,002 B2 * 6/2005 Young et al. ..... 215/375

FOREIGN PATENT DOCUMENTS

EP 0225155 A2 * 6/1987
WO WO 86/05462 * 9/1986
WO WO 92/00880 * 1/1992

* cited by examiner

*Primary Examiner*—Sue A Weaver
(74) *Attorney, Agent, or Firm*—Dykema Gossett PLLC

(57) ABSTRACT

A plastic blow molded container having at least six downwardly projecting legs and a plurality of curved ribs, with each rib located between two downwardly projecting legs. Each rib has an inner portion that extends outwardly from the central axis and an outer portion that extends upwardly from the inner portion, wherein the outer portion of each rib has a circumferential width equal to or greater than the circumferential width of the inner portion.

7 Claims, 3 Drawing Sheets

PLASTIC CONTAINER HAVING A FREESTANDING, SELF-SUPPORTING BASE

CROSS-REFERENCE TO RELATED APPLICATIONS

This application is a continuation-in-part of U.S. patent application Ser. No 29/235,870, filed Aug. 8, 2005, now U.S. Pat. No. D543,462.

BACKGROUND OF THE INVENTION

The present invention relates to plastic blow molded containers having a freestanding, self-supporting base.

It is desirable to provide plastic blow molded containers with a freestanding, self-supporting base which are capable of withstanding internal pressure. It is further desirable to provide such containers with a plurality of unitary legs having lower flat feet separated by curved ribs, and to provide such containers having improved features. Such a base construction is shown by U.S. Pat. Nos. 5,064,080, 5,139,162, 5,287,978, 5,615,790, and 6,019,236. These patents disclose a base construction including a hollow leg, curved ribs, and a central hub construction that has particular utility in withstanding internal pressure such as that generated by carbonated beverages while also having good stability that resists tipping.

It would be desirable to provide such a container having six or more legs while enabling such a container to be readily prepared and with such a container having improved features.

It is therefore a principal object of the present invention to provide an improved plastic blow molded container with a freestanding, self-supporting base.

It is a further object of the present invention to provide an improved container as aforesaid wherein the base includes a plurality of downwardly projecting legs, with good stability and with improved features.

It is a further object of the present invention to provide an improved container as aforesaid with good stability, which maintains its structural rigidity in a simple design and which can be readily prepared on a commercial scale.

It is a still further objective of the present invention to provide an improved container as aforesaid which has an aesthetically pleasing design and which is cost effective.

Further objects and advantages of the present invention will appear hereinbelow.

SUMMARY OF THE INVENTION

In accordance with the present invention the foregoing objects and advantages are readily obtained.

The plastic blow molded container of the present invention has a central axis, a freestanding, self-supporting base, a body portion extending upwardly from the base, and a neck portion extending upwardly from the body portion, said neck portion including a dispensing opening therein, said base comprising:

at least six, and preferably six to eight, downwardly projecting hollow legs spaced circumferentially from each other, each leg having a lower flat foot coplanar with the feet of the other legs to cooperate therewith in supporting the container in an upright position;

a plurality of curved ribs spaced circumferentially from each other, with each rib located between two downwardly projecting legs, said ribs corresponding in number to the number of legs, said ribs connecting to the adjacent side walls of the legs, each rib having an inner portion that extends outwardly from the central axis and an outer portion that extends upwardly from the inner portion for connection to the body portion, wherein the outer portion of each rib has a circumferential width equal to or greater than, preferably greater than, the circumferential width of the inner portion thereof; and a generally round hub located along the central axis, wherein the curved ribs and legs extend radially therefrom.

Further features of the present invention will appear hereinbelow.

BRIEF DESCRIPTION OF THE DRAWINGS

The present invention will be more readily understandable from a consideration of the accompanying drawings, wherein.

DETAILED DESCRIPTION OF PREFERRED EMBODIMENTS

Figure 1:
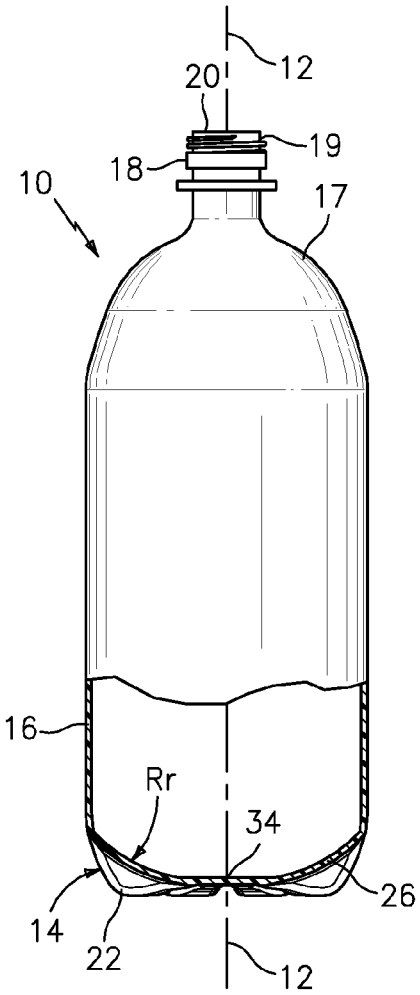
FIG. 1 is a side elevational view taken partly in section of a plastic blow molded container of the present invention.

Referring to FIG. 1, a plastic blow molded container 10 is shown with a central axis 12 that extends vertically, a self-supporting, freestanding base 14, a cylindrical body portion 16 extending upwardly from the base around the central axis, and a neck portion 18 extending upwardly from the body portion including a dispensing opening 20 therein, which is illustrated as having a thread 19 for an unshown cap-type closure. Inwardly extending shoulder portion 17 is provided on the upper portion of the body portion beneath the neck portion. The base 14 is a freestanding base structure, which is highly desirable as for a container holding carbonated beverages, as will be discussed more fully hereinbelow.

Figure 3:
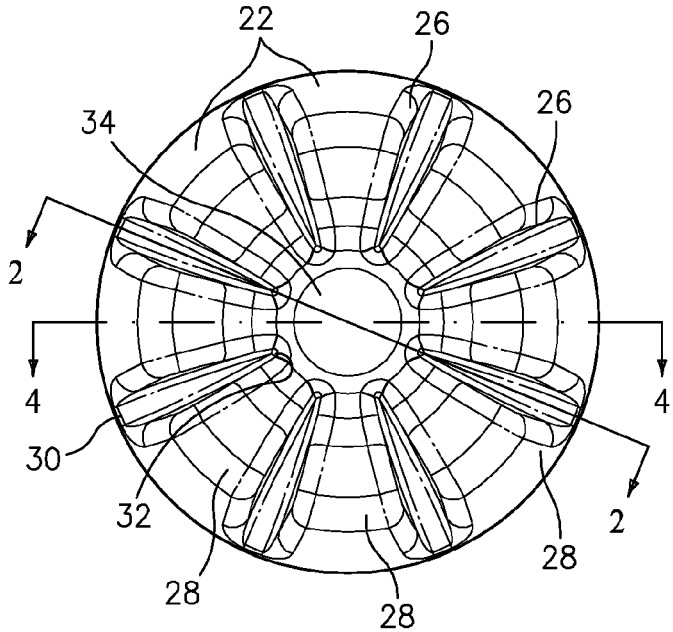
FIG. 3 is a bottom plan view of the base.
Figure 4:
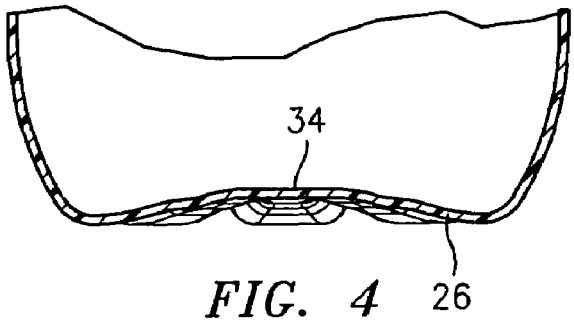
FIG. 4 is a sectional view along lines 4-4 of FIG. 3.
Figure 5:
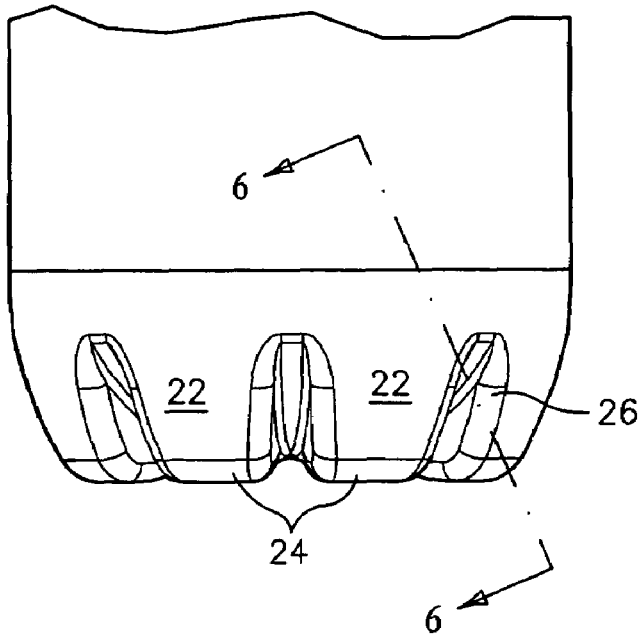
FIG. 5 is a side view of the container base and a portion of the sidewall.
Figure 6:
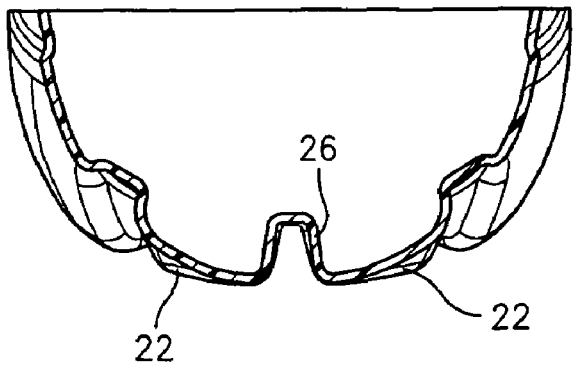
FIG. 6 is a sectional view along lines 6-6 of FIG. 5.

With further reference to the drawings, the freestanding base structure 14 includes at least six downwardly projecting hollow legs or feet 22 spaced circumferentially from each other. Each leg has a lower flat foot 24, as can be clearly seen in FIG. 5, coplanar with the feet of the other legs to cooperate therewith in supporting the container in an upright position. Desirably, six to eight legs are provided and in a preferred embodiment eight legs are provided as shown in FIG. 3.

A plurality of curved ribs or struts 26 are spaced circumferentially from each other are provided, with each rib located between two of said downwardly projecting legs 22. As can be clearly seen in FIG. 3, the ribs 26 correspond in number to the number of legs and connect to the sidewalls 28 of the adjacent legs.

Each rib or strut 26 has an outer portion 30 and an inner portion 32. The inner portion 32 extends outwardly from the central axis 12 towards the outer portion 30 and the outer portion 30 extends upwardly away from the inner portion for connection with the body portion 16. Each rib or strut 26 may have a tapered width along its length. Moreover, as can be clearly seen in FIG. 3, the outer portion 30 has a circumferential width equal to or greater than the circumferential width of the inner portion 32, and preferably greater than the circumferential width of the inner portion. This is significant in the present invention with the large number of feet. The greater width of outer portion 30 facilitates the distribution of material into the feet.

The container base of the present invention includes a generally round hub 34 along the central axis 12, wherein the curved ribs 26 and legs 22 extend radially therefrom.

Figure 2:
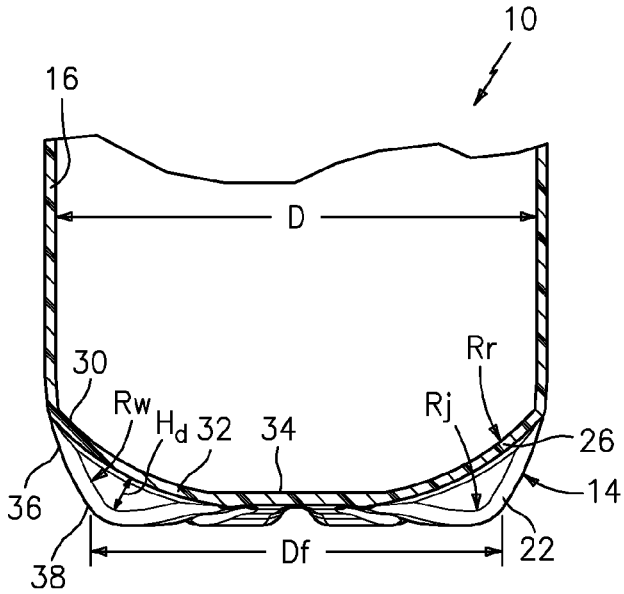
FIG. 2 is an enlarged view of a portion of FIG. 1 illustrating the base structure taken along lines 2-2 of FIG. 3.

In the preferred embodiment the outer diameter of the lowermost portion of the feet Df is 60-80% of the outer diameter D of the body portion, and preferably from 65 to 70% of the outer diameter of the body portion, see FIG. 2. Advantageously, by having the ratio smaller the feet are easier to blow out and the material can be more easily distributed throughout the feet.

In addition, the outer wall 36 of each leg 22 has a radius of curvature Rw from 15 to 80% of the diameter D of the cylindrical body portion, and preferably from 15 to 70% of the diameter of the body portion. The larger the ratio of Rw to D the larger Df becomes. This makes the heel 38 radius further away from the preform and more difficult to distribute plastic into the heel 38. Therefore, the Rw to D ratio should be higher for pressure, but should not be too low for bottle stability.

In addition, each rib 26 has a radius of curvature Rr from 30 to 75% of the diameter of the body portion and preferably from 50 to 70% of the diameter of the body portion. The larger the ratio of Rr to D the easier it is to distribute material throughout the legs and particularly to the heel.

Still further, the radius of curvature of the heel Rj should be less than 25% and greater than 6% of the diameter of the body. The smaller the ratio of the Rj to D the more difficult it is to move material into the heel. Therefore, the heel 38 should have a radius of curvature less than 25% of the diameter D of the body, and more than 6%.

In addition, the distance from the center of the radius Rj to the center of the adjacent radius Rr, which may be designated as the depth of the heel $H_d$, should have a ratio of depth of heel to D of 0.06 to 0.16, i.e., a ratio of the depth of the heel $H_d$ to the diameter of the body of from 0.06 to 0.16. This aids in the stability of the freestanding container of the present invention, with the large number of legs.

Figure 7:
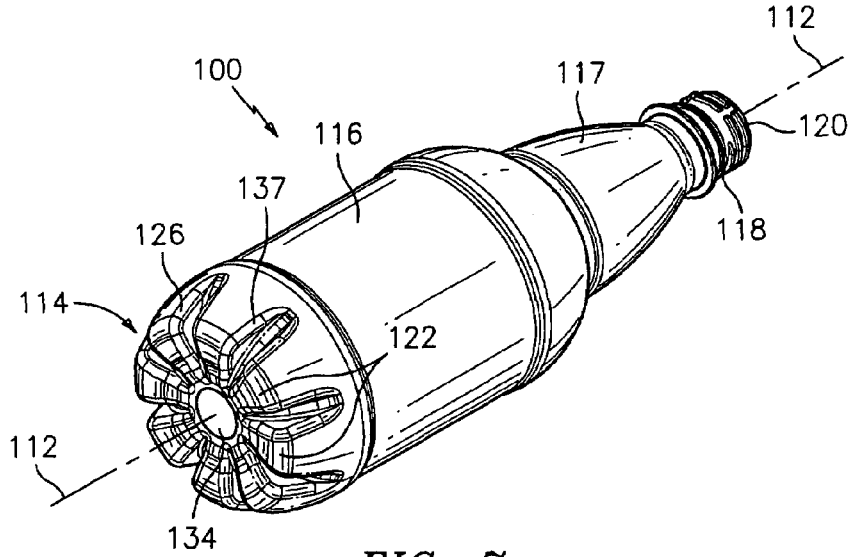
FIG. 7 is a perspective view of an alternate embodiment of the plastic blow molded container of the present invention.
Figure 9:
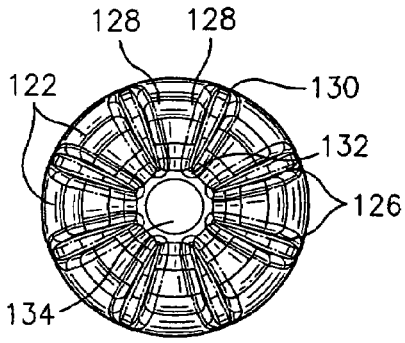
FIG. 9 is a bottom plan view of the container of FIG. 7.
Figure 8:
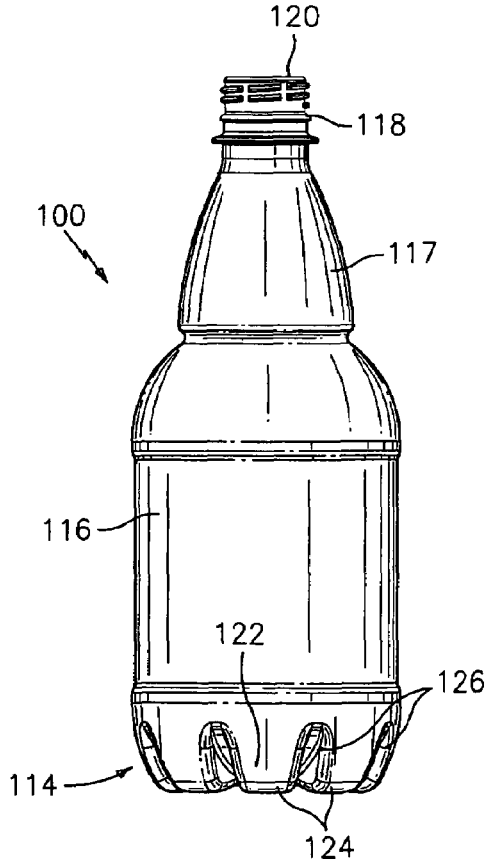
FIG. 8 is a side elevational view of the container of FIG. 7.

The alternate embodiment of FIGS. 7-9 shows a smaller container 100, which can for example be a beer, juice or soft drink bottle. Although the specific configuration of the container above the base is not especially critical, container 100 has a central axis 112 that extends vertically, a self-supporting, freestanding base 114, a cylindrical body portion 116 extending upwardly from the base around the central axis, and a neck portion 118 extending upwardly from the body portion including a dispensing opening 120 therein. Body portion 116 as shown in the embodiment of FIGS. 7-9 includes an inwardly extending shoulder portion 117 on the upper portion thereof beneath the neck portion.

The freestanding base structure 114 of FIGS. 7-9 includes eight downwardly projecting hollow legs or feet 122 spaced circumferentially from each other with each leg having a lower flat foot 124 as can be clearly seen in FIG. 8, coplanar with the feet of the other legs in supporting the container in an upright position. In addition, a plurality of curved ribs or struts 126 are spaced circumferentially from each other, with each rib located between two of the downwardly projecting legs 122. The ribs correspond in number to the number of legs and connect to the sidewalls 128 of the adjacent legs. As in the embodiment of FIGS. 1-6, each rib or strut 126 has an outer portion 130 and an inner portion 132. The inner portion 132 extends outwardly from the central axis 112 towards the outer portion 130 and the outer portion extends upwardly away from the inner portion for connection with the body portion in upwardly extending portion 137, as can be clearly seen in FIG. 7. In addition, the outer portion 130 has a circumferential width equal to or greater than the circumferential width of the inner portion 132, and preferably greater than the circumferential width of the inner portion.

Container base 114 also includes a generally round hub 134 along the central axis 112, wherein the curved ribs 126 and legs 122 extend radially therefrom.

Thus, it can be seen that the features of the container base 114 of FIGS. 7-9 are similar to the features of the container base of FIGS. 1-6. The outer diameter features, the radius of curvature features and the other base features of the embodiment of FIGS. 7-9 fall into the ranges described hereinabove.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic blow molded container having a central axis, a freestanding, self-supporting base, a body portion extending upwardly from the base, and a neck portion extending upwardly from the body portion said neck portion including a dispensing opening therein, said base comprising:

at least six downwardly projecting hollow legs spaced circumferentially from each other, each leg having a lower flat foot coplanar with the feet of the other legs to cooperate therewith in supporting the container in an upright position;

a plurality of curved ribs spaced circumferentially from each other with each rib located between two downwardly projecting legs, said ribs corresponding in number to the number of legs, said ribs having a tapered width along the length thereof and connecting to the legs, each rib having an inner portion that extends outwardly from the central axis and an outer portion that extends upwardly from the inner portion for connection to the body portion, wherein the outer portion of each rib has a circumferential width greater than the circumferential width of the inner portion thereof; and a generally round hub located along the central axis, wherein the curved ribs and legs extend radially therefrom;

wherein the body portion has a diameter; each rib has a radius of curvature (Rr) from 30 to 75% of the diameter of the body portion; the legs include a heel having a radius of curvature (Rj) from 6 to 25% of the diameter of the body portion; the distance between the center of the radius of curvature (Rj) of the heel of the legs and the center of the adjacent radius of curvature (Rr) of the ribs is the depth of the heel, and the ratio of the depth of the heel to the diameter of the body is from 0.06 to 0.16.

2. A container according to claim 1, including from six to eight of said legs.

3. A container according to claim 2, including eight of said legs.

4. A container according to claim 2, wherein the body portion has an outer diameter (D) and the legs have an outer diameter (Df), and the outer diameter (Df) of the lower most portion of the legs is 60 to 80% of the outer diameter (D) of the body portion.

5. A container according to claim 4, wherein the outer diameter of the lowermost portion of the legs is 65 to 70% of the outer diameter of the body portion.

6. A container according to claim 2, wherein each leg has an outer wall and the body portion is a cylindrical body portion which has a diameter, and wherein the outer wall of each leg has a radius of curvature from 15 to 80% of the diameter of the cylindrical body portion.

7. A container according to claim 2, wherein the body portion includes an upper inwardly extending shoulder portion.

* * * * *